US009657914B2

(12) United States Patent
Anderson et al.

(10) Patent No.: US 9,657,914 B2
(45) Date of Patent: May 23, 2017

(54) COLLAPSIBLE LAMP SHADE SYSTEM

(71) Applicant: RED DOOR INTERIORS, Olympia, WA (US)

(72) Inventors: Lara Anderson, Olympia, WA (US); Kathleen L. Lathrop, Olympia, WA (US)

(73) Assignee: Red Door Interiors, Olympia, WA (US)

( * ) Notice: Subject to any disclaimer, the term of this patent is extended or adjusted under 35 U.S.C. 154(b) by 0 days.

(21) Appl. No.: 14/994,994

(22) Filed: Jan. 13, 2016

(65) Prior Publication Data

US 2016/0201871 A1 Jul. 14, 2016

Related U.S. Application Data

(60) Provisional application No. 62/102,960, filed on Jan. 13, 2015.

(51) Int. Cl.

| | |
|---|---|
| ***F21V 1/06*** | (2006.01) |
| *F21V 1/14* | (2006.01) |
| *F21W 121/00* | (2006.01) |

(52) U.S. Cl.

CPC ..... *F21V 1/06* (2013.01); *F21V 1/143* (2013.01); *F21W 2121/00* (2013.01)

(58) Field of Classification Search

CPC ..... F21V 1/06; F21V 1/14; F21V 1/143

See application file for complete search history.

(56) References Cited

U.S. PATENT DOCUMENTS

| | | | |
|---|---|---|---|
| 2,111,844 | A | 3/1938 | Davidson |
| 2,606,280 | A | 8/1952 | Stroschein |
| 2,884,515 | A | 4/1959 | Fogel |
| 2,900,865 | A | 8/1959 | Mayon |
| 3,023,307 | A | 2/1962 | Okamoto |
| 3,141,446 | A | 7/1964 | Nittka |
| 3,764,801 | A | 10/1973 | Mainieks |
| 4,055,760 | A | 10/1977 | Weisbrod |
| 4,075,684 | A | 2/1978 | Witz |
| 4,212,052 | A | 7/1980 | Chambard |

(Continued)

FOREIGN PATENT DOCUMENTS

TW EP 2098777 A2 * 9/2009 ..... F21V 1/06

OTHER PUBLICATIONS

Sunnemo, Inter IKEA Systems B.V., Apr. 1, 2014; AA-1179673-1.

*Primary Examiner* — Bao Q Truong
*Assistant Examiner* — Nathaniel Lee
(74) *Attorney, Agent, or Firm* — Holland & Hart LLP

(57) ABSTRACT

A collapsible lamp shade system that allows easy updating of room décor using a collapsible shade wrap. The collapsible shade wrap may include a top attachment mechanism to secure the top edge of the collapsible shade wrap to a top lamp shade fitter and a bottom attachment mechanism to secure the bottom edge of the collapsible shade wrap to a bottom ring. The top and/or bottom attachment mechanisms may wrap around a top and/or bottom ring of a lamp shade fitter. The collapsible shade wrap may include a separating closure mechanism to attach the sides of the collapsible shade wrap together to provide interchangeable lamp shade décor with a tailored look.

17 Claims, 7 Drawing Sheets

(56) References Cited

U.S. PATENT DOCUMENTS

| | | | | |
|---|---|---|---|---|
| 4,275,434 | A * | 6/1981 | Borowitz | F21S 8/06 362/311.01 |
| 5,211,474 | A | 5/1993 | Leitner et al. | |
| 5,662,412 | A * | 9/1997 | Glendmyer | F21V 1/26 362/351 |
| 6,561,682 | B1 * | 5/2003 | Juang | F21V 1/06 362/352 |
| 6,729,747 | B1 | 5/2004 | Wirayani | |
| 6,746,137 | B1 | 6/2004 | Yeh | |
| 6,773,145 | B2 | 8/2004 | Yang | |
| 6,786,621 | B2 | 9/2004 | Sviland | |
| 6,857,766 | B2 | 2/2005 | Verdi | |
| 7,267,458 | B2 | 9/2007 | Bin | |
| 7,347,593 | B1 | 3/2008 | Swanson | |
| 7,631,996 | B2 | 12/2009 | Huang | |
| 8,235,557 | B2 | 8/2012 | Brown | |
| 8,292,476 | B2 | 10/2012 | Wu | |
| 8,596,833 | B1 | 12/2013 | Cytrynowicz | |
| 8,668,367 | B2 | 3/2014 | Anderson et al. | |
| 2003/0200689 | A1 * | 10/2003 | Cohon | G09F 5/04 40/673 |
| 2005/0117355 | A1 * | 6/2005 | Hsu | F21V 1/06 362/414 |
| 2008/0192486 | A1 * | 8/2008 | Lien | F21V 17/007 362/352 |
| 2009/0196051 | A1 | 8/2009 | Dick et al. | |
| 2015/0204506 | A1 * | 7/2015 | Wu | F21V 1/04 362/351 |

* cited by examiner

COLLAPSIBLE LAMP SHADE SYSTEM

BACKGROUND

Decorative lamp shades are used in interior decorating to update the style of lamps to match the desired decor. Lampshades are attached to the lamp by way of a lamp harp, a metal wire that typically attaches below the light bulb socket. Lamp shades typically have a wire at the top and bottom that provides structure and are supported at the top wire by the finial base of the lamp harp. Lamp shades may be made from a wide range of materials including glass, fabric, or fabric with a polystyrene base material.

To update a room's decor, typically lamp shades are replaced with shades with a different color, fabric, and/or pattern to match the new decor or seasonal change. Because lamp shades are bulky and have a rigid structure they are difficult to ship and store.

SUMMARY

The present disclosure, for example, describes a collapsible shade wrap for a lamp shade system, including a pliable backing material (e.g., styrene, PVC, etc.) in a lamp shade pattern, a fabric covering adhered to the pliable backing material and forming a decorative covering of the lamp shade, a top attachment mechanism proximate to a top edge of the lamp shade pattern and configured to attach the collapsible shade wrap to a top ring of a lamp shade fitter, a bottom attachment mechanism proximate to a bottom edge of the lamp shade pattern and configured to attach the collapsible shade wrap to a bottom ring, and a closure mechanism that attaches a first side edge of the lamp shade pattern to a second side edge of the lamp shade pattern. The attachment mechanisms may be detachable (e.g., separating fasteners) such that the lamp shade system can be assembled for use and disassembled for storing in a compact form.

In some embodiments, the top and/or bottom attachment mechanisms includes one or more extension portions extending beyond the backing material. The one or more extension portions may be portions of the fabric covering. The top and bottom attachment mechanisms may include a separating fastener including a first type of fastener element on the extension portions and a second, mating type of fastener element on an inside surface of the collapsible shade wrap.

In some embodiments, the collapsible shade wrap includes at least one housing mechanism to hold at least one vertical support member attached to an inside surface of the collapsible shade wrap and extending from proximate to a top edge of the collapsible shade wrap to proximate to a bottom edge of the collapsible shade wrap.

The closure mechanism may be, for example, a textile hook and loop separating fastener or a separating zipper. For example, a separating zipper may be sewn onto the decorative fabric covering at the first and second sides of the collapsible shade wrap.

The lamp shade pattern may be, for example, an arc lamp shade pattern forming a truncated cone when the separating closure mechanism is closed or a rectangular lamp shade pattern forming a cylinder shape when the separating closure mechanism is closed. The pliable backing material may be styrene or poly-vinyl chloride.

Some embodiments are directed to a lamp shade system including a collapsible shade wrap as described above. The lamp shade system may include a collapsible shade wrap and a lamp shade fitter. The lamp shade fitter may include a top lamp shade ring and a bottom lamp shade ring. In some embodiments, the bottom lamp shade ring is a separate component of the lamp shade fitter from the top lamp shade ring.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The decor of a room may be updated by replacing lamp shades to match new paint, furniture, and other home decorating accessories. For example, rooms may be updated seasonally by replacing lamp shades with shades having seasonal patterns on them. Presently, this is done by replacing the entire shade with a new shade having a different color, pattern, and/or material. However, the bulkiness and fragility of lamp shades makes them difficult and expensive to store and ship. Lamp shades are expensive to ship because they require a large box but they weigh almost nothing. In addition, lamp shades are very vulnerable and they can easily get damaged during shipping. In some instances, the cost of storing and shipping lamp shades may have a substantial effect on product pricing. Consumers may limit the number of décor options they purchase because of the expense of shipping and storing traditional lampshades.

Described embodiments include collapsible lamp shade system that allows easy updating of room décor using a collapsible shade wrap. The collapsible shade wrap is a multi-layer assembly where attachment mechanisms wrap around the top and/or bottom rings of a lamp shade fitter assembly to maintain a clean appearance even when viewed from above or underneath. The attachment mechanisms may include extension portions or flaps that wrap around the top and/or bottom rings to secure the collapsible shade wrap to the lamp shade fitter assembly. The attachment mechanisms may include separating fasteners with fastener elements on the extension portions and the inside surface of the collapsible shade wrap. The separating fasteners may be, for example, textile hook and loop separating fasteners ("Velcro"), interlocking profiles, snaps, and the like. For example, the covering layer (e.g., fabric) may extend past the backing material to create flaps that can be wrapped around the top and/or bottom rings of the lamp shade fitter assembly and secured with the separating fastener(s). The collapsible shade wrap may include a separating closure mechanism to attach the sides of the collapsible shade wrap together to provide interchangeable lamp shade décor with a tailored look.

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Figure 1:
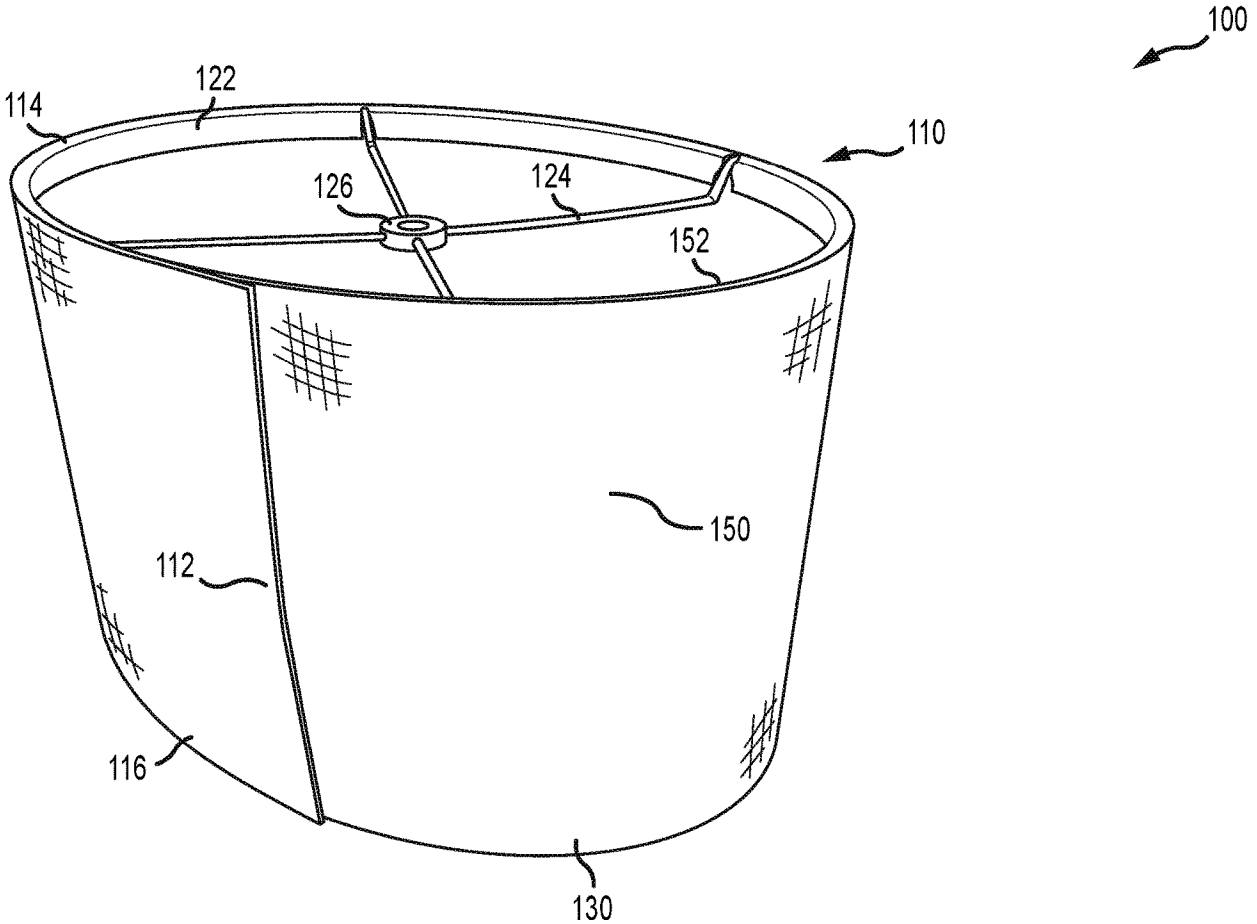
FIG. 1 illustrates an interchangeable lamp shade system 100 that allows easy updating of room décor according to various embodiments.

FIG. 1 illustrates a lamp shade system 100 that allows easy updating of room décor, according to various embodiments. The lamp shade system 100 includes a collapsible shade wrap 110 and a lamp shade frame that includes a top lamp shade fitter 120 and bottom ring 130. As shown in FIG. 1, the lamp shade fitter 120 is a spider type fitter that includes a top ring 122 supported by a spider 124 and a washer 126 that fits over the finial base of a lamp harp (not shown) to support the spider 124. However, lamp shade fitter 120 may have other configurations including a wire clip that fits on to a light bulb or light bulb socket for lamps that do not have a lamp harp (uno or clip-on lamp shade attachment). Lamp shade fitter 120 may be attached via one or more vertical support members (not shown) to the bottom ring 130. Alternatively, lamp shade fitter 120 and bottom ring 130 may be separate components not connected together with vertical support members.

The collapsible shade wrap 110 is a multi-layer assembly that is created in a lamp shade pattern. In some embodiments, collapsible shade wrap 110 is constructed with a decorative covering material 150 adhered to a pliable, yet rigid, backing material 152. For example, collapsible shade wrap 110 may be constructed using self-adhesive styrene or poly vinyl chloride (PVC), as a backing material, covered with fabric of a selected design. However, the backing material 152 for collapsible shade wrap 110 may be made from other suitable pliable yet rigid materials.

The collapsible shade wrap 110 includes a closure mechanism 112 that attaches the side edges of the lamp shade pattern together to form a lamp shade shape. Closure mechanism 112 may be, for example, a separating zipper or a separating Velcro closure. The collapsible shade wrap 110 may include top attachment mechanism 114 to attach the collapsible shade wrap 110 to the top ring 122 of the lamp shade fitter 120.

The top attachment mechanism 114 may include multiple attachment elements located near the top edge of the collapsible shade wrap that are continuous or spaced apart from each other (e.g., equally, etc.). For example, the collapsible shade wrap 110 may include flaps that wrap around the top ring 122 and attach to the inside of the collapsible shade wrap 110 via an attachment mechanism (e.g., Velcro, interlocking profiles, snaps, etc.).

The collapsible shade wrap 110 may be detachably attached to the bottom ring 130 using one or more bottom attachment mechanisms 116. The bottom attachment mechanism 116 may include one or more attachment elements located near the bottom edge of the collapsible shade wrap 110 that are continuous or spaced apart from each other (e.g., equally, etc.). For example, the bottom attachment mechanism 116 may include flaps that wrap around the bottom ring 130 and attach to the inside of the collapsible shade wrap 110 via an attachment mechanism (e.g., Velcro, interlocking profiles, snaps, etc.). In other embodiments, the bottom attachment mechanism 116 may be a material forming a channel around the inside of the collapsible shade wrap 110.

In some embodiments, the lamp shade frame includes a top fitter 120 that includes the top ring 122, spider 124, and washer 126, and a separate bottom ring 130, without vertical supports connecting the top fitter 120 and the bottom ring 130. In some embodiments, the collapsible shade wrap 110 includes the vertical support member (not shown). For example, the vertical support member may be inserted into a fabric sleeve that is attached to the inside of the collapsible shade wrap 110. The vertical support member may be, for example, a metal or stiff plastic bar or rod. Thus, when the collapsible shade wrap 110 is installed on the top fitter 120 and bottom ring 130, the vertical support member may provide structural rigidity in the vertical direction for the collapsible lamp shade system 100. The collapsible shade wrap 110 may be removed from the top fitter 120 and the bottom ring 130 and rolled up for shipping or storage, with the vertical support member(s) still in place in the collapsible shade wrap 110. The lamp shade system 100 may include multiple vertical support members, in some examples.

Figure 2:
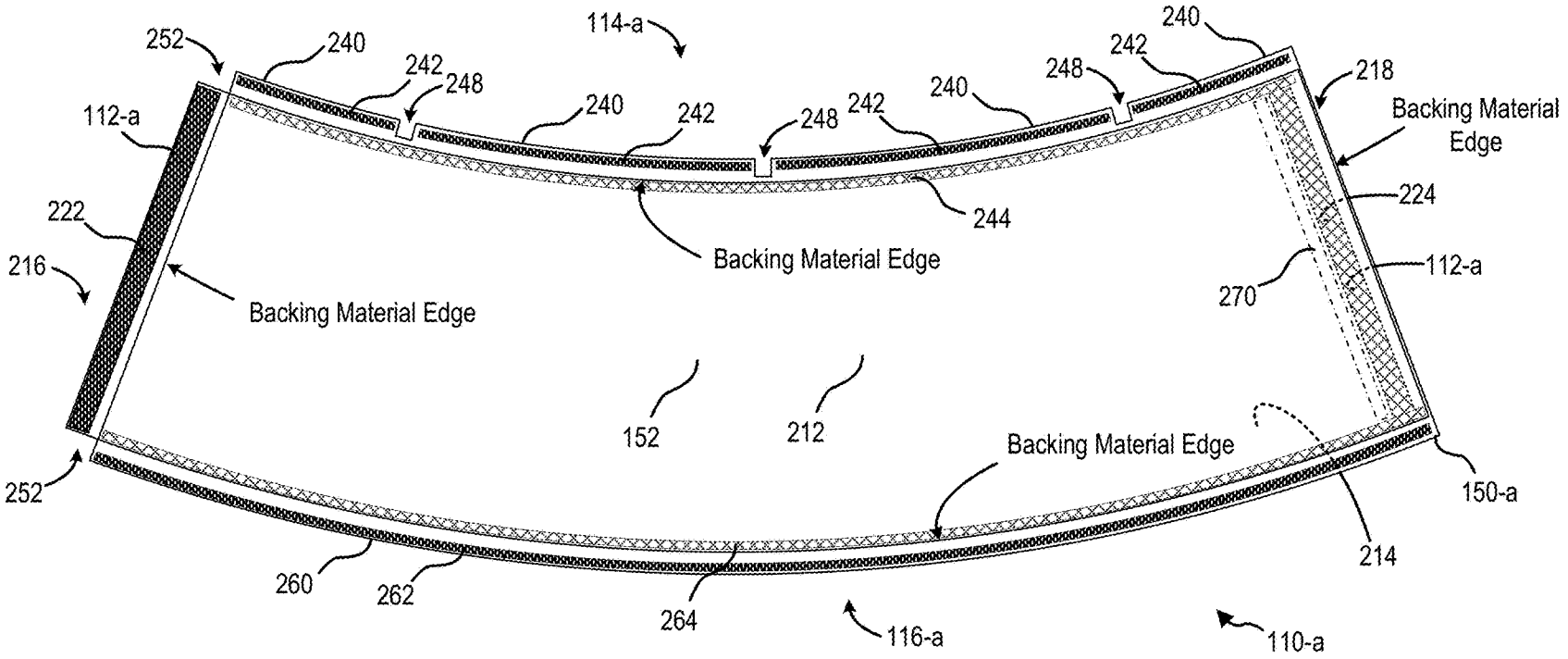
FIG. 2 illustrates a collapsible shade wrap in accordance with various embodiments.

FIG. 2 illustrates a collapsible shade wrap 110-*a* in accordance with various embodiments. Collapsible shade wrap 110-*a* includes top attachment mechanism(s) 114-*a*, bottom attachment mechanism(s) 116-*a*, and separating closure mechanism 112-*a*. While collapsible shade wrap 110-*a* is illustrated as forming a traditional truncated cone lamp shade pattern, collapsible shade wrap 110-*a* may be formed in other lamp shade patterns (e.g., drum, barrel, square, rectangular, etc.) as desired.

The collapsible shade wrap 110-*a* includes a backing material 152, which may be styrene (e.g., pressure sensitive styrene ("PSS"), etc.), poly vinyl chloride (PVC), or other suitable backing material for a lamp shade. The backing material 152 may be cut (e.g., die cut, etc.) into a lamp shade pattern. A decorative fabric 150-*a* may be adhered (e.g., glued, taped, sewn, etc.) to the backing material 152-*a* to form the outside surface 214 of the collapsible shade wrap 110-*a*.

FIG. 2 shows the inside surface 212 of the collapsible shade wrap 110-*a*. The top attachment mechanism 114-*a* includes a number of extension portions (e.g., flaps) 240 separated by notches 248 created in the lamp shade assembly 110-*a*. Each flap 240 may be an extension of the decorative fabric covering the outside of the collapsible shade wrap 110-*a* past the backing material. Each flap 240 may have a first type of separating fastener element 242 attached. Below the flaps 240, a second, mating type of separating fastener element 244 may be attached to the inside surface 212 of the backing material 152-*a*. The first type of separating fastener element 242 and second type of separating fastener element 244 may be separated by a distance approximately equal to the circumference of common fitter rings, thus holding the ring securely when the first type of separating fastener element 242 is attached to the second type of separating fastener element 244. The first type of separating fastener 242 may be, for example, Velcro loop strips while the second type of separating fastener element 244 may be Velcro hook strips. Alternatively, first type of separating fastener 242 may be Velcro hook strips while the second type of separating fastener element 244 may be Velcro loop strips. In other embodiments, the first and second types of separating fastener elements may include interlocking profiles (e.g., structures that couple together when pressure is applied and may be detached via separating force), and/or snaps.

The flaps may be created prior to installing the separating fastener element 242, or one separating fastener element 242 may be attached at the top edge of the shade wrap assembly 110-*a* and notches 248 may be cut to create the flaps 240. The notches 248 are spaced to accommodate the arms of a spider (not shown) of a lamp shade fitter (not shown). In some examples, the notches 248 may be slits (e.g., made with a single cut in the decorative fabric 150-*a* and separating fastener element 242).

The bottom attachment mechanism 116-*a* may have one or more extension portions (e.g., flaps) 260 with a first type of separating fastener 262 attached (e.g., glued, sewn, etc.) on the inside. Above the flap 260, a second, mating type of separating fastener 264 may be attached to the inside surface of the backing material 152-*a*. The first type of separating fastener element 262 and second type of separating fastener element 264 may be separated by a distance approximately equal to the circumference of common fitter rings, thus holding the bottom ring securely when the first type of separating fastener element 262 is attached to the second type of separating fastener element 264. The bottom attachment mechanism 116-*a* may be configured to hold a bottom ring (not shown) by inserting the bottom ring and securing the first type of separating fastener 262 to the second type of separating fastener 264 around the bottom ring. The first and second types of separating fastener elements may include, for example, Velcro hook and loop strips, interlocking profiles, and/or snaps. In some examples, notches (not pictured) may be cut in the flap 260 to create multiple bottom flaps, which may ease installation for some lamp shade shapes.

The separating closure mechanism 112-*a* includes a first type of separating fastener 222 that is adhered (e.g., glued, taped, sewn, etc.) to the inside surface 212 of the lamp shade assembly 110-*a* at a first edge 216 and a second type of separating fastener 224 that is adhered (e.g., glued, taped, sewn, etc.) to the outside surface 214 of the collapsible shade wrap 110-*a* at a second edge 218. For example, the decorative fabric 150-*a* may extend past the backing material 152 at the first edge 216 to create a flap (with notches 252 at the top and bottom separating the flap from the extension portions 240 and 260) and the first type of separating fastener 222 may be adhered to the inside surface of the decorative fabric 150-*a*. The flap may then extend over the outside surface of the second edge 218 when the collapsible shade wrap 110-*a* is assembled on a lamp shade fitter. Alternatively, the first type of separating fastener 222 may be adhered to the outside surface (not shown) at the second edge 218 and the second type of separating fastener 224 may be adhered to the inside surface 212 at the first edge 216.

In embodiments, the collapsible shade wrap 110-*a* includes one or more attachment mechanisms 270 for holding one or more vertical support members (not shown) extending from the top edge (e.g., below the top spider) to the bottom edge (e.g., above the bottom ring). The attachment mechanisms 270 for the vertical support members may be a fabric sleeve or other continuous element, or may include several clips or other smaller attachment mechanisms for holding the vertical support member.

A lamp shade system 100 may include collapsible shade wrap 110-*a* and a lamp shade frame. Referring back to FIG. 1, the lamp shade frame may include a top fitter 120 including a top ring 122 and spider 124, and a bottom ring 130. The frame may include vertical support members connected the top fitter to the bottom ring 130, or the top fitter 120 and the bottom ring 130 may be separate components. A lamp shade may be assembled by matching up the notches 248 at the top of the collapsible shade wrap 110-*a* with the bars of the spider 124 and folding over the fabric flaps to cover the top ring 122, attaching the first type of separating fastener 242 on the flaps to the second type of separating fastener 244 on the inside of the collapsible shade wrap 110-*a*. The bottom ring 130 can be inserted and centered between the first type of separating fastener on the bottom flap 260 and the second type of separating fastener on the inside of the collapsible shade wrap 110-*a*. The bottom flap 260 is then folded over the bottom ring and the first type of separating fastener 262 on the bottom flap 260 is coupled with the second type of separating fastener 264 to securely hold the bottom ring 130. Separating closure mechanism 112-*a* can be secured to complete the lamp shade system 100.

Figure 3:
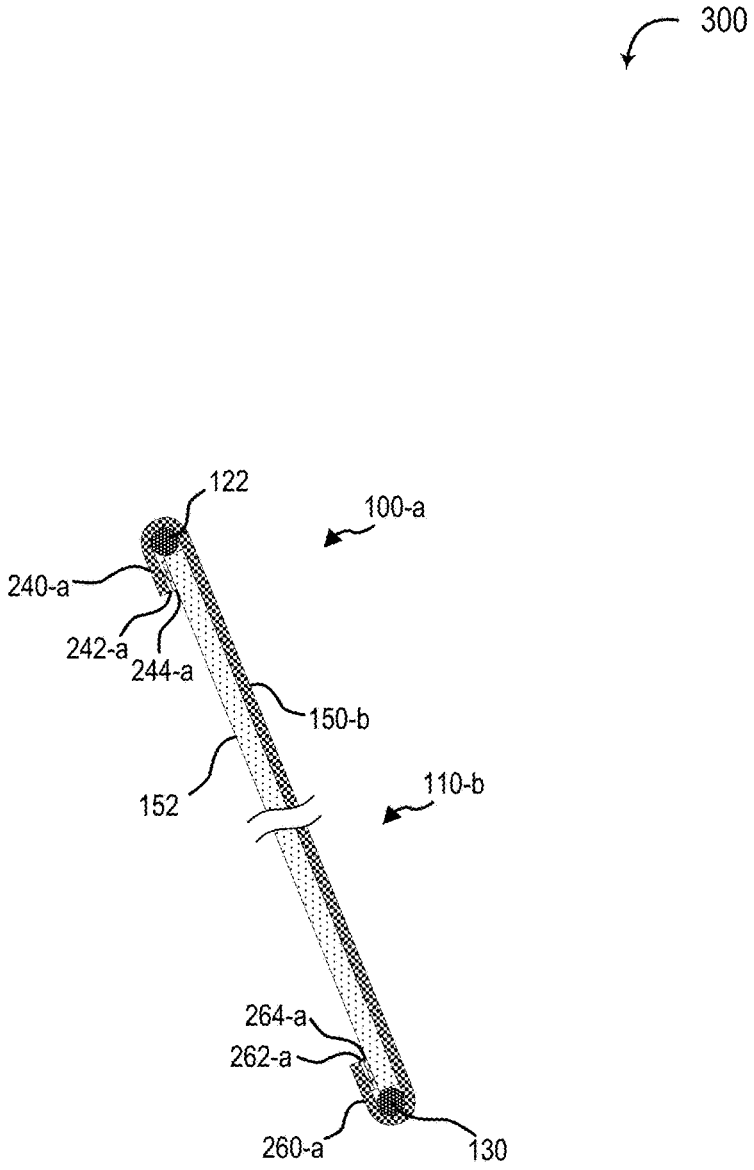
FIG. 3 illustrates a view of a lamp shade system according to various embodiments.

FIG. 3 illustrates a view 300 of a lamp shade system 100-*a* according to various embodiments. Lamp shade system 100-*a* may be an example of lamp shade system 100 of FIG. 1. View 300 may illustrate, for example, a cross-sectional view of a lamp shade system 100-*a* including collapsible shade wrap 110-*b* and components of a lamp shade frame.

As shown in view 300, the top flaps 240-*a* of the collapsible shade wrap 110-*b* are extensions of the fabric covering 150-*b* that wrap over the top ring 122, and the first type of separating fastener 242-*a* (adhered to the top flap 240-*a*) attaches to the second type of separating fastener 244-*a* (adhered to the inside of the backing material 152). Similarly, the bottom flaps 260-*a* of the collapsible shade wrap 110-*b* are extensions of the fabric covering 150-*b* that wrap over the bottom ring 130, and the first type of separating fastener 262-*a* (adhered to the bottom flap 260-*a*) attaches to the second type of separating fastener 264-*a* (adhered to the inside of the backing material 152).

Figure 4:
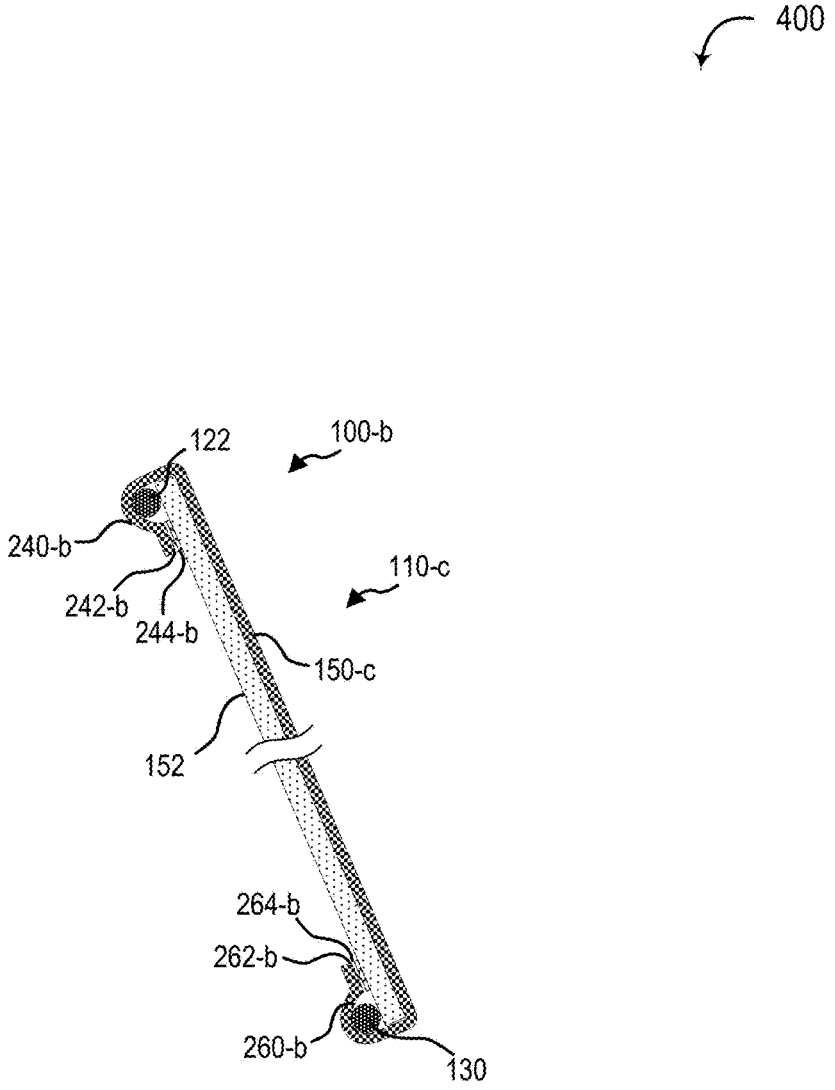
FIG. 4 illustrates a view of a lamp shade system according to various embodiments.

FIG. 4 illustrates a view 400 of a lamp shade system 100-*b* according to various embodiments. Lamp shade system 100-*b* may be an example of lamp shade system 100 of FIG. 1. View 400 may illustrate, for example, a cross-sectional view of a lamp shade system 100-*b* including collapsible shade wrap 110-*c* and components of a lamp shade frame.

As shown in view 400, the top flaps 240-*b* of the collapsible shade wrap 110-*c* are extensions of the fabric covering 150-*c* that wrap over the top ring 122 similarly to collapsible shade wrap 110-*b*. However, the positioning of the first type of separating fastener 242-*b* and the second type of separating fastener 244-*b* are modified such that the top ring 122 is positioned inside the lamp shade system 100-*b* (e.g., with the top of the top ring 122 generally aligned with the top edge of the backing material 152) when the fasteners are attached together. Specifically, the second type of separating fastener 244-*b* is offset from the top edge of the backing material 152 by approximately the diameter of the top ring. The bottom of the lamp shade system 100-*b* may have a similar arrangement, with the bottom ring positioned inside the lamp shade system 100-*b* (e.g., with the bottom of the bottom ring 130 generally aligned with the bottom edge of the backing material 152) when the first type of separating fastener 262-*b* on the bottom flap 260 is attached to the second type of separating fastener 264-*b* on the inside of the backing material 152.

Figure 5:
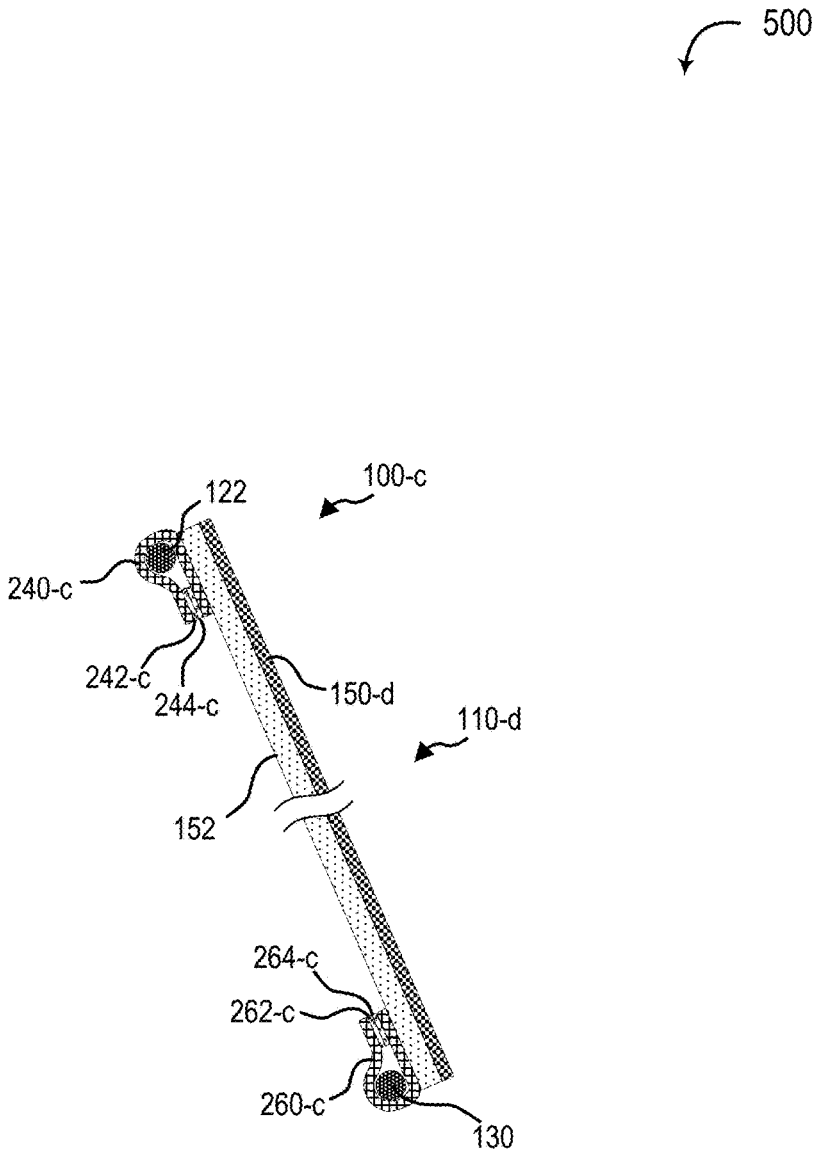
FIG. 5 illustrates a view of a lamp shade system according to various embodiments.

FIG. 5 a view 500 of a lamp shade system 100-*c* according to various embodiments. Lamp shade system 100-*c* may be an example of lamp shade system 100 of FIG. 1. View 500 may illustrate, for example, a sectional view of a lamp shade system 100-*c* including collapsible shade wrap 110-*d* and components of a lamp shade frame.

As shown in collapsible shade wrap 110-*d*, flap 240-*c* may be made of a separate piece of material (e.g., fabric), adhered (e.g., glued, sewn) on the inside of the backing material 152. The first type of separating fastener 242-*c* may be adhered to the inside of the flap 240-*c*, while the second type of separating fastener 244-*c* may be adhered to the separate material or to the inside of the backing material 152, in some cases. In some examples, the separate piece of material extends across the inside surface of the backing material 152. The fabric covering 150-*d* may be adhered to and cover the outer surface of the backing material 152 as shown in FIG. 5, or may wrap over the top and/or bottom edges of the backing material 152, in some cases.

Referring back to FIGS. 1 and 2, the collapsible shade wrap 110-*a* can be rolled-up and stored in a compact manner when the lamp shade system is disassembled. The rolled-up collapsible shade wrap 110-*a*, fitter 120, and bottom ring 130 take up only a fraction of the space of a traditional lamp shade, and can be shipped in smaller boxes, reducing storage overhead and shipping costs for retailers.

In some embodiments, collapsible shade wrap 110-*a* may be configured for assembly in a lamp shade kit but not be interchangeable (e.g., not configured to be removable from the a lamp shade frame once installed). For example, the flaps 240 of the top attachment mechanism 114 may have pre-installed double-sided tape strips instead of the first type of separating fastener 242, and the second type of separating fastener 244 may not be present. Similarly, the flap(s) 260 of the bottom attachment mechanism 116 may have pre-installed double-sided tape strips instead of the first type of separating fastener 262, and the second type of separating fastener 264 may not be present. To assemble the lamp shade kit, backing may be peeled away from the double-sided tape strips, the flaps 240 wrapped over the top ring 122 (e.g., with the arms of the spider at notches 248, etc.), and the double-sided tape strips may adhere the flaps 240 to the inside surface of the collapsible shade wrap 110. Similarly, the bottom flap(s) 260 may be wrapped around a bottom ring 130 and double-sided tape strips may adhere the flap(s) 260 to the inside surface of the collapsible shade wrap 110-*a*. In a non-interchangeable kit, separating closure mechanism 112 may be a separating fastener (e.g., Velcro, zipper, etc.) as described above, or the first type of separating fastener 222 and second type of separating fastener 224 may also be replaced by a double-sided tape strip (e.g., in place of the second type of separating fastener 224). The lamp shade kit may include the collapsible shade wrap 110, the top fitter 120, and bottom ring 130. Thus, although not being interchangeable or collapsible once assembled, the lamp shade kit may be stored and shipped to an end customer without the bulk of a traditional lamp shade.

Figure 6A:
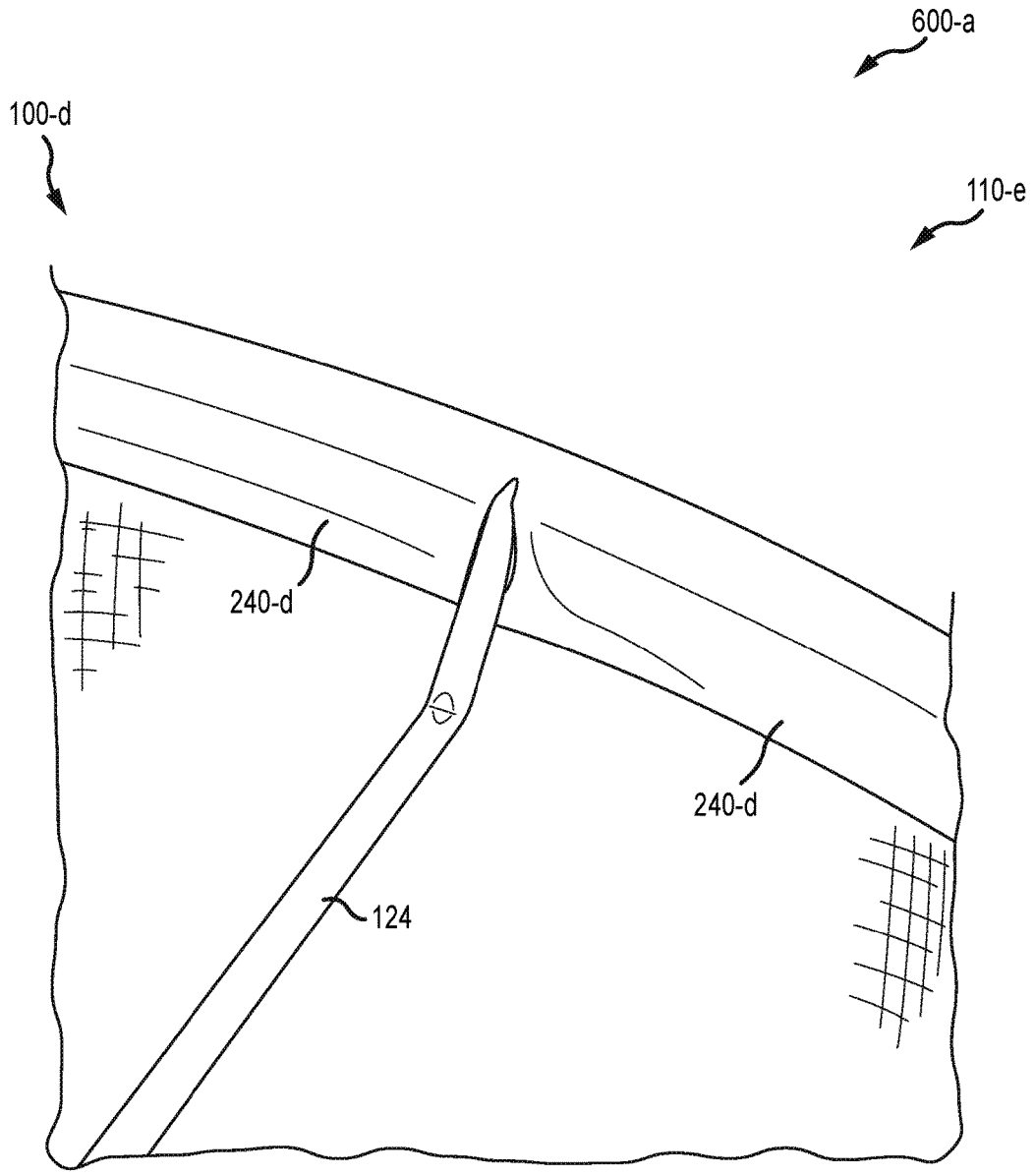
FIGS. 6A and 6B illustrate views of a lamp shade system according to various embodiments.
Figure 6B:
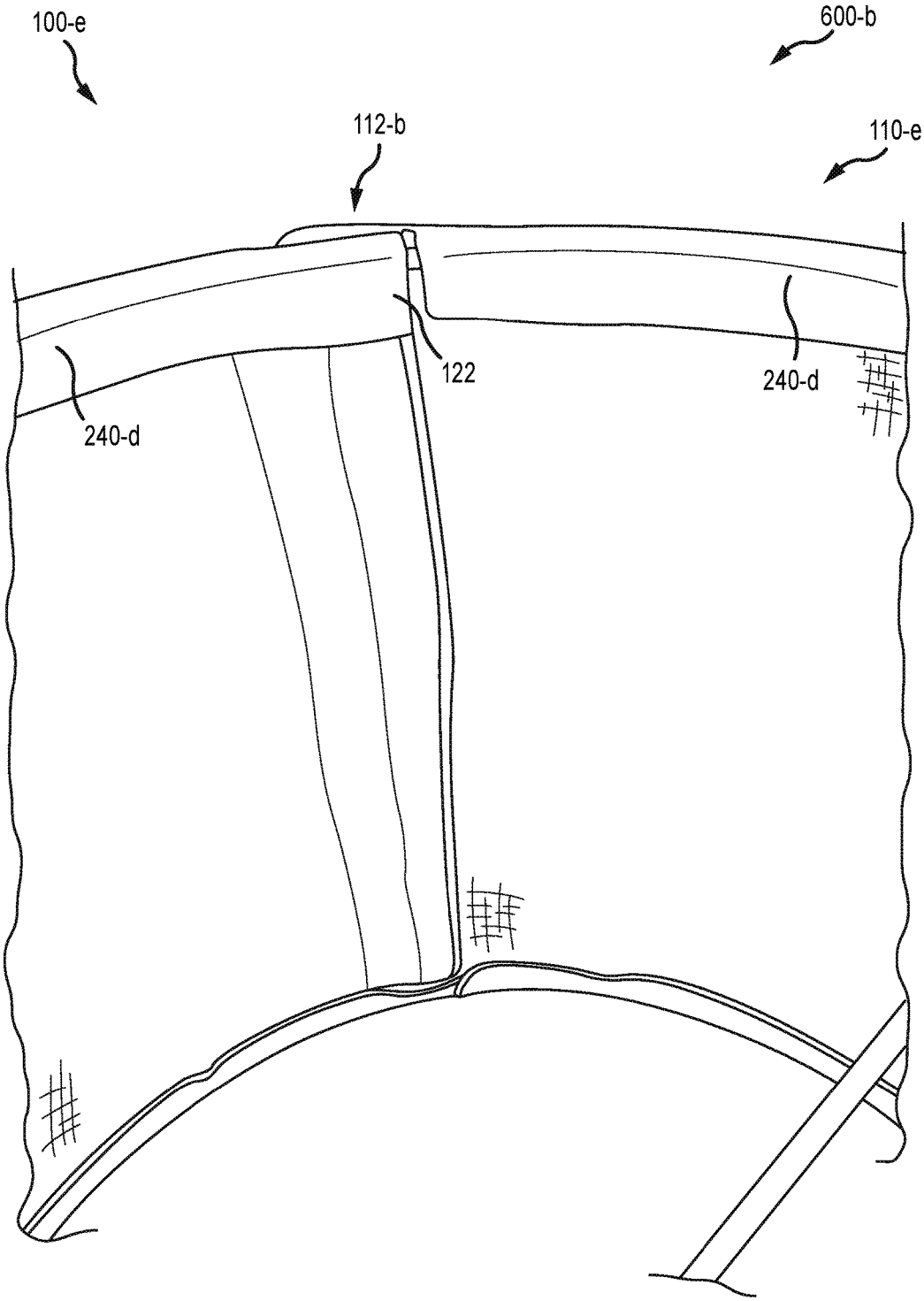

FIGS. 6A and 6B illustrate views 600-*a* and 600-*b*, respectively, of a lamp shade system 100-*d* according to various embodiments. Lamp shade system 100-*d* may be an example of lamp shade system 100 of FIG. 1.

View 600-*a* illustrated in FIG. 6A shows collapsible shade wrap 110-*e* of lamp shade system 100-*d* installed on a top ring 122. As illustrated in FIG. 6A, the flaps 240-*d* install around an arm of the spider 124 and provide a clean look at the top of the lamp shade system 100-*d*.

View 600-*b* illustrated in FIG. 6B shows the inside of the separating closure mechanism 112-*b*. As illustrated in FIG. 6B, the flaps 240-*d* at each side of collapsible shade wrap 110-*e* meet up as installed around the top ring 122 and the separating closure mechanism 112-*b* provides a clean, fitted look.

The foregoing description has been presented for purposes of illustration and description. Specific details are given in the description to provide a thorough understanding of the embodiments. However, it will be understood by one of ordinary skill in the art that the embodiments may be practiced without these specific details. For example, well-known structures, and techniques have been shown without unnecessary detail in order to avoid obscuring the embodiments. Furthermore, the description is not intended to limit embodiments of the invention to the form disclosed herein. While a number of exemplary aspects and embodiments have been discussed above, those of skill in the art will recognize certain variations, modifications, permutations, additions, and sub-combinations thereof.

Thus, various embodiments may omit, substitute, or add various procedures or components as appropriate. It should be noted that the methods, systems and assemblies discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the invention.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, a number of steps may be undertaken before, during, or after the above elements are considered. Accordingly, the above description should not be taken as limiting the scope of the invention.

What is claimed is:

1. A collapsible shade wrap for a lamp shade system, comprising:

a pliable backing material in a lamp shade pattern, wherein the pliable backing material provides rigidity to the collapsible shade wrap for forming a lamp shade structure when attached to a top lamp shade fitter and a bottom ring that is a separate component from the top lamp shade fitter;

a fabric covering adhered to the pliable backing material and forming a decorative covering of the collapsible shade wrap;

a top attachment mechanism configured to detachably attach the collapsible shade wrap to the top lamp shade fitter, the top attachment mechanism comprising one or more top extension portions of the fabric covering extending past a top edge of the pliable backing material, a first top fastener element on a respective one of the one or more top extension portions, and a second top fastener element on an inside surface of the collapsible shade wrap and configured to detachably attach to the first top fastener element with the respective one of the one or more top extension portions of the fabric covering wrapped around a top ring of the top lamp shade fitter, wherein the one or more top extension portions extend along substantially the length of the top edge and, when the first top fastener element is detachably attached to the second top fastener element, cover the top ring such that the top ring is not visible;

a bottom attachment mechanism configured to detachably attach the collapsible shade wrap to bottom ring, the bottom attachment mechanism comprising one or more bottom extension portions of the fabric covering extending past a bottom edge of the pliable backing material, a first bottom fastener element on a respective one of the one or more bottom extension portions and a second bottom fastener element on the inside surface of the collapsible shade wrap and configured to detachably attach to the first bottom fastener element with the respective one of the one or more bottom extension portions of the fabric covering wrapped around the bottom ring, wherein the one or more bottom extension portions extend along substantially the length of the bottom edge and, when the first bottom fastener element is detachably attached to the second bottom fastener element, cover the bottom ring such that the bottom ring is not visible; and a side attachment mechanism that detachably attaches a first side edge of the collapsible shade wrap to a second side edge of the collapsible shade wrap.

2. The collapsible shade wrap of claim 1, wherein the first top fastener element comprises a first type of textile hook and loop separating fastener and the second top fastener element comprises a second, mating type of textile hook and loop separating fastener.

3. The collapsible shade wrap of claim 1, wherein the first top fastener element comprises a first type of interlocking profile and the second top fastener element comprises a second, mating type of interlocking profile.

4. The collapsible shade wrap of claim 1, wherein the first top fastener element comprises a plurality of a first type of snap fasteners, and the second top fastener element comprises a plurality of a second, mating type of snap fasteners.

5. The collapsible shade wrap of claim 1, further comprising:

at least one housing mechanism to hold at least one vertical support member attached to the inside surface of the collapsible shade wrap and extending from proximate to a top edge of the collapsible shade wrap to proximate to a bottom edge of the collapsible shade wrap.

6. The collapsible shade wrap of claim 1, wherein the side attachment mechanism comprises a textile hook and loop separating closure.

7. The collapsible shade wrap of claim 1, wherein the side attachment mechanism comprises a separating zipper.

8. The collapsible shade wrap of claim 1, wherein the lamp shade pattern comprises an arc lamp shade pattern forming a truncated cone when the side attachment mechanism is closed.

9. The collapsible shade wrap of claim 1, wherein the lamp shade pattern comprises a rectangular lamp shade pattern forming a cylinder shape when the side attachment mechanism is closed.

10. The collapsible shade wrap of claim 1, wherein the pliable backing material comprises styrene or poly-vinyl chloride.

11. A lamp shade system, comprising:

a lamp shade fitter comprising a top lamp shade fitter and a bottom lamp shade ring that is a separate component from the top lamp shade fitter;

a collapsible shade wrap comprising:

a pliable backing material in a lamp shade pattern, wherein the pliable backing material provides rigidity to the collapsible shade wrap for forming a lamp shade structure when attached to the top lamp shade fitter and the bottom ring;

a fabric covering adhered to the pliable backing material and forming a decorative covering of the collapsible shade wrap;

a top attachment mechanism configured to detachably attach the collapsible shade wrap to the top lamp shade fitter, the top attachment mechanism comprising one or more top extension portions of the fabric covering extending past a top edge of the pliable backing material, a first top fastener element on a respective one of the one or more top extension portions, and a second top fastener element on an inside surface of the collapsible shade wrap, wherein the one or more top extension portions secure the collapsible shade wrap to the top lamp shade ring when the first top fastener element is detachably attached to the second top fastener element with the one or more top extension portions wrapped around the top lamp shade ring with the respective one of the one or more top extension portions of the fabric covering wrapped around a top ring of the top lamp shade fitter, wherein the one or more top extension portions extend along substantially the length of the top edge and, when the first top fastener element is detachably attached to the second top fastener element, cover the top ring such that the top ring is not visible;

a bottom attachment mechanism configured to detachably attach the collapsible shade wrap to bottom ring, the bottom attachment mechanism comprising one or more bottom extension portions of the fabric covering extending past a bottom edge of the pliable backing material, a first bottom fastener element on a respective one of the one or more bottom extension portions and a second bottom fastener element on the inside surface of the collapsible shade wrap, wherein the one or more bottom extension portions secure the collapsible shade wrap to the bottom lamp shade ring when the first bottom fastener element is detachably attached to the second bottom fastener element with the one or more bottom extension portions wrapped around the bottom lamp shade ring with the respective one of the one or more bottom extension portions of the fabric covering wrapped around the bottom ring, wherein the one or more bottom extension portions extend along substantially the length of the bottom edge and, when the first bottom fastener element is detachably attached to the second bottom fastener element, cover the bottom ring such that the bottom ring is not visible; and a side attachment mechanism that detachably attaches a first side edge of the collapsible shade wrap to a second side edge of the collapsible shade wrap.

12. The lamp shade system of claim 11, wherein the first top fastener element comprises a first type of interlocking profile and the second top fastener element comprises a second, mating type of interlocking profile.

13. The lamp shade system of claim 11, wherein the first top fastener element comprises a plurality of a first type of snap fasteners, and the second top fastener element comprises a plurality of a second, mating type of snap fasteners.

14. The lamp shade system of claim 11, further comprising:

at least one housing mechanism to hold at least one vertical support member attached to the inside surface of the collapsible shade wrap and extending from proximate to a top edge of the collapsible shade wrap to proximate to a bottom edge of the collapsible shade wrap.

15. The lamp shade system of claim 11, wherein the side attachment mechanism comprises a textile hook and loop separating closure.

16. The lamp shade system of claim 11, wherein the side attachment mechanism comprises a separating zipper.

17. The lamp shade system of claim 11, wherein the pliable backing material comprises styrene or poly-vinyl chloride.

* * * * *